United States Patent [19]

DeWitt, III

[11] Patent Number: 4,701,144

[45] Date of Patent: Oct. 20, 1987

[54] BREAKAWAY SURFBOARD FIN HOLDER

[76] Inventor: Glen A. DeWitt, III, San Andreas Rd., Watsonville, Calif. 95077

[21] Appl. No.: 839,107

[22] Filed: Mar. 13, 1986

[51] Int. Cl.[4] ..... A63C 15/05

[52] U.S. Cl. ..... 441/79; 114/132

[58] Field of Search ..... 441/79, 74; 114/127, 114/132, 140, 143, 39.2, 165; 403/2, 381; 440/56, 88

[56] References Cited

U.S. PATENT DOCUMENTS

| | | | |
|---|---|---|---|
| 1,822,573 | 8/1931 | Fitzgerald et al. | 440/88 X |
| 3,564,632 | 2/1971 | Bahne, Jr. | 441/79 |
| 4,364,324 | 12/1982 | Warner | 403/2 X |
| 4,398,485 | 8/1983 | Diziere | 114/132 |

FOREIGN PATENT DOCUMENTS

| | | | |
|---|---|---|---|
| 696179 | 10/1964 | Canada | 440/56 |
| 3239441 | 5/1984 | Fed. Rep. of Germany | 114/143 |
| 2510968 | 2/1983 | France | 441/79 |

*Primary Examiner*—Jeffrey V. Nase
*Assistant Examiner*—Paul E. Salmon

[57] ABSTRACT

A breakaway surfboard fin holder is provided which is used in conjunction with a surfboard having a fin supporting channel mounted in the lower, rear surface of the surfboard. A fin is provided having an anchoring tongue extending rearwardly along the top of the fin. A support pin is carried by the anchoring tongue and slidably engages elongated grooves formed in the channel. A breakaway tab is carried by the forward portion of the fin so that, when the fin strikes an obstruction, the breakaway tab fails at a predetermined level of force so that the fin itself is not damaged, but may be reused by insertion of a replacement tab and remounting of the forward portion of the fin in the fin supporting channel.

3 Claims, 5 Drawing Figures

BREAKAWAY SURFBOARD FIN HOLDER

BRIEF SUMMARY OF THE INVENTION

This invention relates generally to surfboarding, windsurfing and any related water sport using a surfboard guided by a fin. More particularly, this invention relates to a breakaway surfboard fin holder which is an improvement over U.S. Pat. No. 3,564,632 dated Feb. 23, 1971 to Bahne.

The prior art fin holders such as Bahne teach a fin supporting channel mounted in the lower rear surface of the surfboard wherein the channel has a pair of elongated grooves and wherein a fin is connected to the elongated grooves of the channel in such a manner that the placement of the fin is adjustable along the longitudinal axis of the surfboard. A significant problem with the prior art Bahne fin holder is that, if the fin strikes an obstruction during forward motion of the surfboard, the forward portion of the fin is forced downwardly out of the fin supporting channel and in the process the fin is invariable split and rendered useless. A further disadvantage is that when the fin is broken in this fashion, the user typically has a major problem in replacing the fin and, in many occasions, the entire fin supporting channel in the base of the surfboard must also be replaced.

The present invention provides a breakaway surfboard fin holder which provides the feature of adjustability of the fin along the longitudinal axis of the surfboard and which provides a breakaway mechanism wherein a replaceable breakaway tab is designed to fail at a predetermined force level when the fin strikes an obstruction during forward motion of the surfboard.

A primary object of the invention is to provide a breakaway tab which avoids destruction of a surfboard fin when the fin strikes an obstruction.

A further object of the invention is to provide a breakaway surfboard fin holder which avoids destruction of the fin support channel mounted in the lower, rear surface of a surfboard when the fin strikes an obstruction.

A further object of the invention is to provide a quickly and easily replaceable breakaway tab which makes it possible for a surfboard user to overcome the striking of an obstruction with the surfboard fin by replacing a breakaway tab and remounting the fin, all without the use of any special tools.

A further object of the invention is to provide an improved surfboard fin holder which is quickly and easily mounted, which is adjustable and in which the fin itself is not destroyed upon striking an obstruction.

Other objects and advantages of the invention will become apparent from the following description and the drawings.

DETAILED DESCRIPTION OF THE DRAWINGS

Figure 1:
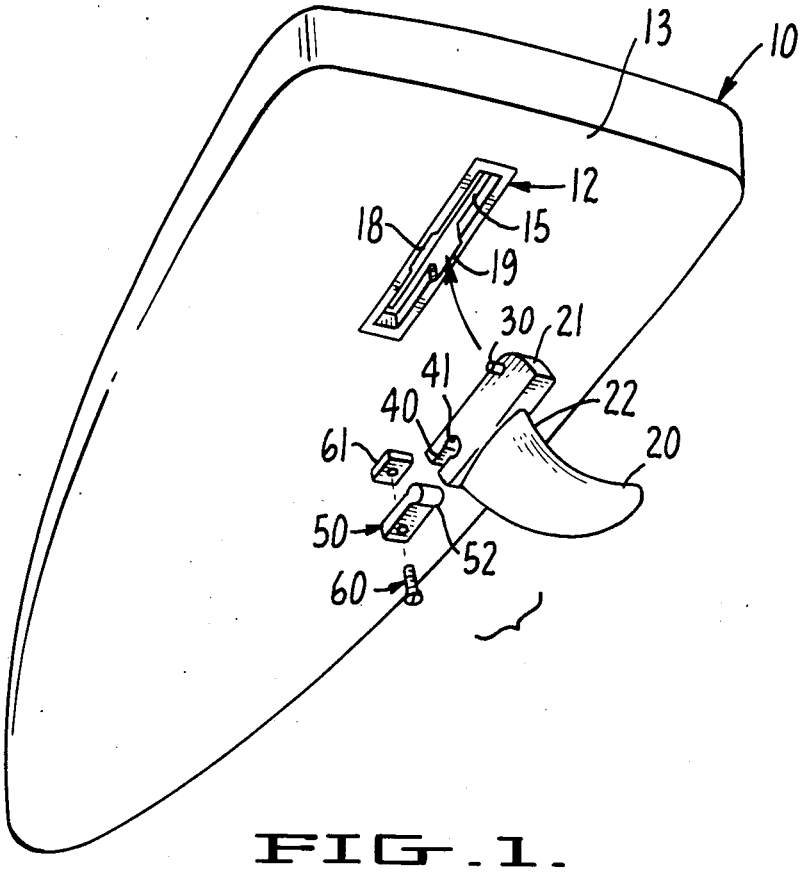
FIG. 1 is a perspective view of the lower portion of a surfboard with the components of this invention shown in an exploded view.
Figure 5:
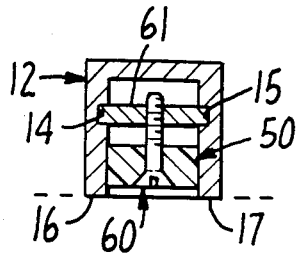
FIG. 5 is a section on the line 5—5 of FIG. 2.

FIG. 1 shows a typical surfboard 10 with a metallic or plastic fin supporting channel 12 mounted in the lower, rear surface 13 of fiberglass surfboard 10. As shown best in FIG. 5, channel 12 has a pair of elongated grooves 14 and 15 which are formed in side walls 16 and 17, respectively. Grooves 14 and 15 extend substantially the length of channel 12 as shown in FIG. 2.

Fin 20, typically made of fiberglass or plastic, has an anchoring tongue 21 extending rearwardly along the top of fin 20 and which extends past the rear edge 22 of fin 20.

Figure 4:
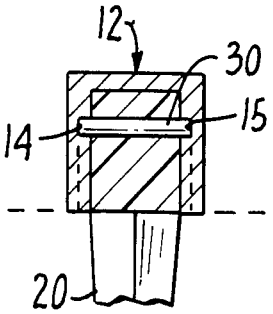
FIG. 4 is a section on the line 4—4 of FIG. 2.

Pin means 30, which comprises a hollow steel pin, is carried by anchoring tongue 21 and is adapted to slidably engage elongated grooves 14 and 15 as shown best in FIG. 4. Pin 30 is inserted into grooves 14 and 15 through recesses 18 and 19 formed in the side walls of channel 12 and is pushed rearwardly in grooves 14 and 15 to a desired position.

Figure 2:
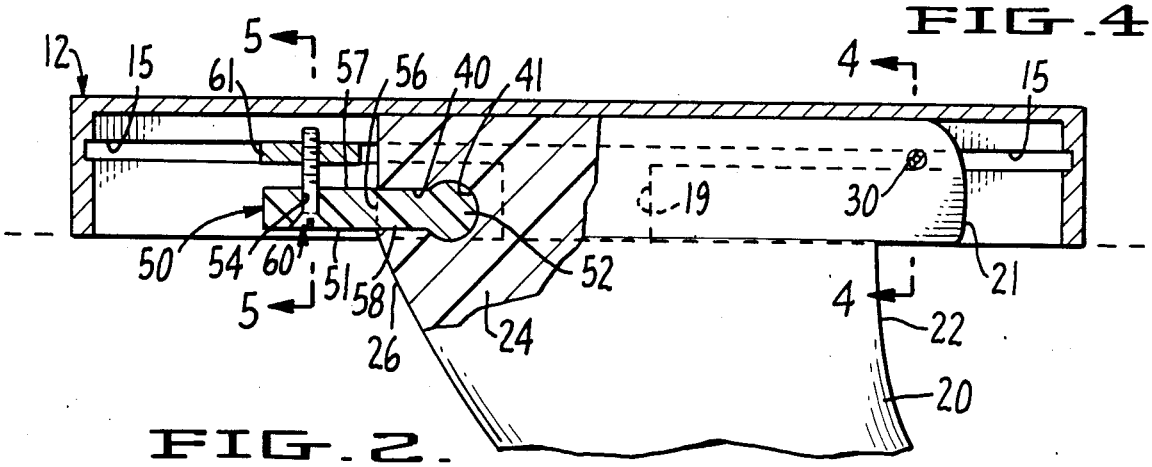
FIG. 2 is a side elevational view, partly in section, of the fin supporting channel and which shows the instant invention.
Figure 3:
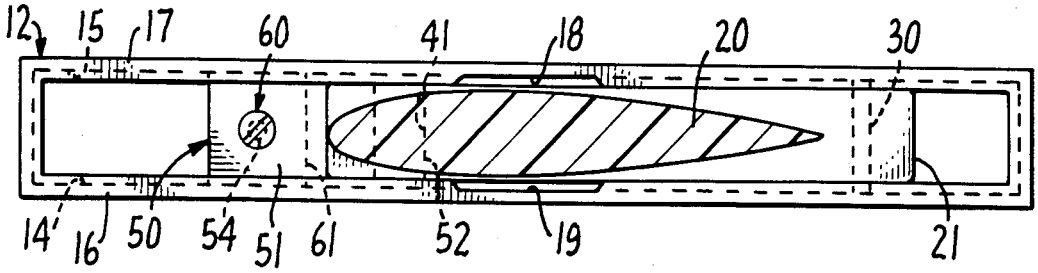
FIG. 3 is a lower plan view of the fin supporting channel and a fin in place in the channel.

The forward portion 24 of fin 20 has a slot 40 formed therein as shown best in FIGS. 1 and 2. Slot 40 terminates in an enlarged circular recess 41.

Breakaway tab 50, typically molded of plastic, has an elongated body portion 51 and an enlarged head portion 52 and is adapted to slidably fit into slot 40 and engage the surfaces of slot 40 and recess 41. The enlarged recess 41 and enlarged head of tab 50 cooperate to prevent relative movement of tab 50 and fin 20 along the longitudinal axis of surfboard 10.

Tab 50 has a countersunk passageway 54 formed therein for receiving connecting means 60 which is a tapered head screw and a cooperating flat nut 61. Flat nut 61 is sized so that it slidably engages grooves 14 and 15 as shown best in FIG. 5.

Tab 50 extends forwardly past the forward edge 26 of fin 20. Tab 50 has a shear plane 56 formed adjacent the forward edge 26 of fin 20 which is a plane of slightly weakened material so that failure will occur on shear plane 56 (represented by dotted lines) when a predetermined shear force is applied to tab 50. The shear plane is formed in the molding process by filling the mold from two directions, with the flow from both directions meeting at shear plane 56. Shear plane 56 is approximately 10% weaker in shear than the adjacent regions 57 and 58 of tab 50. When the predetermined force is applied, as for example by the fin 20 striking an obstruction, tab 50 fails at shear plane 56, and the forward edge 26 of fin 20 drops downwardly. Fin 20 at this point is suspended by pin 30 and fin 20 rotates relative to channel 12 and also with respect to surfboard 10.

In operation, when such failure occurs, the user simply uses a dime to unscrew connecting means 60, removes the broken pieces of tab 50 from connecting means 60 and from slot 40, inserts a new tab 50 into slot 40, rotates fin 20 back up into position and threads connecting means 60 back into place.

I claim:

1. An improved surfboard fin holder for use in conjunction with a surfboard having a fin-supporting channel mounted in the lower, rear surface of the surfboard, wherein the channel has a pair of elongated grooves, the improvement comprising:

a fin having an anchoring tongue extending rearwardly along the top of said fin, pin means carried by said anchoring tongue adapted to slidably engage said elongated grooves of said channel, breakaway tab means carried at the forward portion of said fin, wherein said breakaway tab means comprises:

a slot formed in the upper, forward portion of said fin, a tab removably carried by said slot, said tab extending forwardly past the forward edge of said fin, and connecting means for detachably connecting said tab to said elongated grooves of said channel;

such that when said fin strikes an obstruction, said breakaway tab means fails at a predetermined level of force such that the fin itself is not damaged, but may be reused by insertion of a replacement tab and remounting of the forward portion of said fin in said channel.

2. The apparatus of claim 1 wherein said tab has an enlarged head at its end and said slot terminates in an enlarged recess to slidably receive said tab, whereby relative movement of said tab and said fin along the longitudinal axis of said surfboard is prevented.

3. The apparatus of claim 2 wherein said tab has a shear plane formed therein which is weaker in resisting shear than are the regions adjacent said shear plane.

* * * * *